United States Patent [19]

Doetzer et al.

[11] Patent Number: 4,948,475

[45] Date of Patent: Aug. 14, 1990

[54] ION BARRIER LAYER ON METALS AND NONMETALS

[75] Inventors: Richard Doetzer; Georg Iwantscheff, both of Nuremberg, Fed. Rep. of Germany

[73] Assignee: Siemens Aktiengesellschaft, Berlin & Munich, Fed. Rep. of Germany

[21] Appl. No.: 250,947

[22] Filed: Sep. 29, 1988

[30] Foreign Application Priority Data

Sep. 29, 1987 [DE] Fed. Rep. of Germany ..... 3732805

[51] Int. Cl.[5] ..... C25D 3/44

[52] U.S. Cl. ..... 204/58.5

[58] Field of Search ..... 204/58.5

[56] References Cited

U.S. PATENT DOCUMENTS 4,101,386 7/1978 Dotzer ..... 204/33

FOREIGN PATENT DOCUMENTS 0044668 1/1982 European Pat. Off. .
2146346 3/1973 Fed. Rep. of Germany .
3104161 8/1982 Fed. Rep. of Germany .
3111369 11/1982 Fed. Rep. of Germany .
2020699 11/1979 United Kingdom .

*Primary Examiner*—T. M. Tufariello
*Attorney, Agent, or Firm*—Kenyon & Kenyon

[57] ABSTRACT

The invention provides an ion barrier formed of a high-purity electroplated aluminum layer (purity >99.99%) which preferably has a thickness of 10 to 20 μm for use on structural parts and shapes of metals and nonmetals, in particular on polyolefins. If desired, the electroplated aluminum layer can be compacted and/or anodically oxidized by post-treatment. The electroplated aluminum layer prevents the intrusion of metal and nonmetal ions into nonmetals, particularly plastic (for example polyolefins), and their penetration to metal surfaces. The deposition of the electroplated aluminum layer occurs from aprotic, oxygen-free and anhydrous electrolyte media of the general formula $M^IX.2AlR_3.nLsm$, wherein $M^I$ is an alkali metal ion or a quaternary onium ion, X is a halogen ion, preferably $F^-$ or $Cl^-$, R is an alkyl radical, preferably $CH_3$, $C_2H_5$, $C_3H_7$ or $C_4H_9$, Lsm is an aromatic solvent molecule, preferably toluene, ethyl benzene, xylene or a mixture thereof, and n=0 to 12, at a bath temperature of 50° to 110° C. and a current density of 0.5 to 10 A/dm$^2$ under intensive bath movement. The media may possibly be in the presence of an aromatic solvent.

9 Claims, No Drawings

ION BARRIER LAYER ON METALS AND NONMETALS

BACKGROUND OF THE INVENTION

The invention relates to an ion barrier layer on metals and nonmetals (particularly polyolefins), and to a method for its production.

It is known that nonmetals serve as suitable insulating materials on metallic conductors of electric current because of their extremely low electroconductivity. The insulating properties of these nonmetals are impaired by in-diffusion of metal ions from the conductor material, particularly by the in-diffusion of heavy metal ions. However, these nonmetals also undergo a structural degradation due to catalytic reactions which are triggered by the in-diffusing metal ions. The catalytic reactions intensify at elevated temperatures and the nonmetals are thereby severely damaged or even destroyed. Ions of the heavy metals, such as copper, silver, nickel, cobalt, manganese, and their alloys, are particularly destructive, causing depolymerization reactions and oxidative degradation of polyolefins nonmetals such as polyethylene, polypropylene, and their copolymers.

On the other hand, nonmetal ions, particularly oxygen and sulfide ions, can also create a problem. These ions are able to penetrate through nonmetal layers, for example, layers of plastics such as polyolefins, and thereby chemically attack the heavy metal surfaces to form, for example, oxides or sulfides of the metals. The oxides or sulfides can invade the nonmetals and bring about adverse changes by initiating chemical structural alterations. The purely mechanical bond between metal and nonmetal (i.e., between conductor metal and non-conductor layer) is loosened and broken as a consequence. The electrical properties of metallic conductors are thereby reduced, and consequently, their use and practical value are impaired or rendered uncertain.

The prior art has attempted to avoid such damage and defects by placing relatively thick, and hence expensive, intermediate layers of tin or nickel between the conductor metal and the non-conductor, or, by mixing certain inhibitor substances into the polyolefins which bind the metal ions and eliminate or abate their harmful effect. In most cases, however, additives of these or other types adversely affect the quality of the electrical and mechanical properties of the insulating materials and effect only a partial solution to the problem. Sufficient protection could not be obtained, especially at elevated service temperatures of the insulated conductor.

From the European patent application published under number 0 044 668, it is known to employ aluminum foils as oxygen ion barriers. The aluminum foils should have a thickness of more than 15μm, preferably 20μm. According to the embodiment example, the aluminum foil is 25μm thick. Wrapping and gluing are necessary steps. As to process technology, the cladding of the conductor with metal foil must be gapless, which is expensive and difficult to realize.

It is an object of the present invention to protect components and shaped parts of metals and nonmetals (particularly of plastic, such as polyolefins) against in-diffusing metal ions and to prevent the accompanying thermocatalytic degradation which is brought about by such in-diffusion, particularly by the heavy metal ions of copper, silver, nickel, cobalt, manganese, and their alloys while at the same time avoiding the chemical attack on metals and metal alloys caused by in-diffusing nonmetal ions, particularly oxygen and sulfide ions.

SUMMARY OF INVENTION

The object of the invention is achieved by providing an electroplated aluminum ion barrier layer having a purity of greater than 99.99% and which preferably has a thickness of 10 to 20 μm, on structural parts and shapes of metals and nonmetals, in particular on polyolefins. If desired, the electroplated aluminum layer can be compacted and/or anodically oxidized by post-treatment. The electroplated aluminum layer prevents the intrusion of metal and nonmetal ions into nonmetals, particularly plastic (for example polyolefins), and their penetration to the underlying metal surfaces. The invention further relates to a method for the production of an ion barrier layer on metallic materials and nonmetallic materials with an electroconductive surface. The deposition of the electroplated aluminum layer occurs from an aprotic, oxygen-free and anhydrous electrolyte media of the general formula $M^IX.2AlR_3.nLsm$, wherein $M^I$ is an alkali metal ion or a quaternary onium ion, X is a halogen ion, preferably $F^-$ or $Cl^-$, R is an alkyl radical, preferably $CH_3$, $C_2H_5$, $C_3H_7$ or $C_4H_9$, Lsm is an aromatic solvent molecule, preferably toluene, ethyl benzene, xylene or a mixture thereof, and n=0 to 12. The media may possibly be in the presence of an aromatic solvent, at a bath temperature of 50 to 110.C and a current density of 0.5 to 10 A/dm$^2$ under intensive bath movement.

DESCRIPTION OF THE PREFERRED EMBODIMENT

The high-purity electroplated aluminum layer of the invention can act as a protective and intermediate layer which is an excellent ion barrier up to temperatures of at least 300° C. The aluminum layer preferably has a thickness of 10–20 μm. The electroplated aluminum layer of the invention protects metal and nonmetal conductive surfaces (e.g., the polyolefins) against invasion of metal ions, which can initiate catalytic oxidation reactions which can damage the polymer structure or even destroy it through depolymerization. Nonmetal surfaces can be made conductive by application of an electroconductive metal, graphite, or carbon layer as thin as about 0.05 to 2 μm. The electroplated aluminum layer of the invention also protects metals, particularly metal surfaces, against penetrating metal or nonmetal ions, which can adversely alter the metals. Oxygen or sulfide ions can oxidatively or sulfidizingly attacking them and nobler metal ions can attack the metals with a cementing and alloying effect. Both solid and tubular conductors can be coated with the electroplated aluminum ion barrier layer of the invention in a continuous ("run-through") operation which will prevent a penetration of ions (e.g., oxygen or sulfide ions) toward the interior of the conductor up to a temperature of 300° C., or, prevent penetration of ions (e.g., copper or nickel ions) from the interior of the conductor outward into the applied insulator material.

The electroplated aluminum ion barrier layer of the invention can be applied using current densities of 0.5 to 3 A/dm$^2$. For conductor materials which are coated continuously in continuous electroplating installations in counterflow to the electrolyte, a higher current density of 3 to 10 A/dm$^2$ can be used.

Suitable aprotic oxygen-free and anhydrous electrolyte media are those of the general formula $M^IX.2AlR_3.nLsm$, where $M^I$ is an alkali metal ion or a quaternary onium ion, X is a halogen ion, preferably $F^-$ or $Cl^-$, R is an alkyl radical, preferably $CH_3$, $C_2H_5$, $C_3H_7$ or $C_4H_9$, Lsm is a molecule of an aromatic solvent, preferably toluene, ethyl benzene or xylene or a mixture thereof, and n=0 to 12.

To obtain a homogeneous and dense electrocrystalline electroplated aluminum structure, reversing or pulsed currents are preferably employed. The electroplated aluminum layer can further be compacted and strengthened mechanically by blasting with glass beads or hard-particle drumming.

If the electroplated aluminum surface of the invention is subsequently coated with an insulating material (e.g., a polyolefin) from the melt or by hot pressing, the adhesion between the electroplated aluminum and the insulating material can be increased by producing an anodically oxidized electroplated aluminum layer ("Galvano-Aluminum-Eloxal") about 2 to 6μm thick, by anodic oxidation. This can be done in known GS, GX, or mixed baths. Due to the surface-active microstructure and ceramic-like surface properties, excellent bonding strengths for plastics and adhesives result.

Conductors, shaped parts and components coated in accordance with the invention provide a high-grade and durable insulation of current-carrying parts and equipment which is stress-resistant within narrow limits and which does not permit a reduction of the insulation properties of the nonconductors (e.g., plastic, particularly polyolefins). The electroplated aluminum ion barrier layer of the invention prevents the degeneration of the insulation properties of nonconductors. This degeneration is brought about directly or indirectly (e.g., by catalyzation of degrading reactions) by metal ions diffusing in from the metallic part of the conductor or of the equipment.

In view of the known high susceptibility of plastics to penetration by hydrogen, hydroxyl, and sulfide ions, the invention can also be used to protect the plastics against the ions or to prevent the ions from penetrating to the chemically sensitive metal substrates. Thus, the invention averts the formation of reaction products at the metal surfaces, (e.g., oxides, hydroxides and sulfides), which may reduce the bonding strength and lead to increased formation of interfering metal ions, which then in turn intensify the further catalytic degradation of the insulator structure.

There are also parts and components of metallic material which are sensitive to atmospheric agents. If these atmospheric agents have unhindered access to the parts, the function of the parts are impaired. Examples include shaped parts of lithium or Li-containing light metal alloys, for instance AlLi3, or the excellent magnet material $SmCo_5$. There are also metals which are poisonous and must, for safety reasons, be "wrapped" for handling, such as shaped parts of beryllium, thallium, and uranium. In all of the above-mentioned cases, an ion barrier of electroplated aluminum applied from aprotic, oxygen-free and anhydrous aluminum-organic complex salt electrolytes protects and preserves the parts and components from internal and external agents. This protective barrier can be further strengthened by anodic oxidation to "Galvano-Al-Eloxal". The electroplated aluminum which is firmly deposited electrochemically under cathodic load of the shaped part on the surface thereof, is bright silver, unusually ductile, has good electroconductivity and is nonmagnetic.

The invention will be explained more specifically by the following examples.

EXAMPLE 1

Polyolefin insulator coating (particularly of polyethlyene or polypropylene) for conductors of copper may be protected against thermal as well as oxidative degradation of the crosslinked polymer structure, caused by copper ions, by application of an electroplated aluminum layer about 10μm thick on the surface of the copper conductor before cladding with polyolefin (by hot extrusion). The electroplated aluminum layer serves as an ion barrier layer for heavy metal ions including copper ions.

An electrolytic copper wire (99.95% Cu) having a diameter of 3 mm customary for current conduction purposes in electrical engineering, which has previously been run through a degreasing and then through a pickling bath, is washed in a water jet tube and subsequently dried in an (infra)red radiation drier ("red light canal") under nitrogen in countercurrent. Immediately thereafter, the copper wire thus pretreated is coated with about 10 μm electroplated aluminum all around in a continuous aluminum-plating installation in countercurrent to the electrolyte of the complex salt electrolyte $NaF.2Al(C_2H_5)_3.4\ C_7H_8$, with toluene as solvent, at a bath temperature of 100 to 110° C .and a current density of about 6 $A/dm^2$. Adhering electrolyte is rinsed away with toluene, and the surface wet with toluene is then dried in a hot nitrogen stream.

The copper wire thus adheringly coated with about 10 um electroplated aluminum is then cladded with hot polyolefin, preferably polypropylene, in a conventional wire extruding/coating machine. If possible, the cladding with polyolefin is conducted immediately after electroplating or after storage in dust-free dry air in order to ensure that a high-grade insulating layer is created. The microcrystalline electroplated Al surface offers a very good substrate for polyolefin cladding. After cooling, the insulated copper wire can be wound on a drum; the elasticity of the polypropylene and the high ductility of the electroplated aluminum permit this.

To show the effectiveness of the electroplated Al ion barrier layer, test pieces, about 80 cm long, of wire coated directly on the copper with polyolefin having a thickness of about 2.5 mm and test pieces of a wire previously covered with about 10 um electroplated Al and then coated with about 2.5 mm polyolefin were stored in a hot-air annealing furnace and observed as to appearance (discoloration) and mechanical behavior of the polyolefin layer for 10 days at 60, 100 and 120° C. respectively. At all test temperatures, the polyolefin layer of the test pieces coated with electroplated aluminum remained completely colorless and elastic under bending during the entire test period. However, in the other test pieces which have no electroplated Al ion barrier, a relatively fast yellowing occurred with increasing test temperatures. At 60° C. the yellowing was perceptible after 9 days, but at 100° C. the yellowing appeared after 4 days, and at 120° C. the yellowing appeared on the second day. After 10 days of 120° C. of thermal load a distinct loss of bending elasticity is observable in the sample without the Al barrier, as recognizable by fissures in the polyolefin layer. The electroplated Al ion barrier layer is therefore effective against the copper ions of electric copper conductors with polyolefin insulation for the great majority of operating temperatures under 100° C., as demonstrated above. The effectiveness of the Al ion barrier layer is also evidenced by the finding that it is only above 300° C. that a very slow in-diffusion of copper in electroplated aluminum begins at a rate of less than 1 um/h with alloy formation. For other heavy metals this diffusion threshold temperature is even higher. For nickel and cobalt, in-diffusion does not begin until temperature of 400 and 450° C. respectively.

EXAMPLE 2

Atmospheric agents, particularly oxygen, hydroxyl, carbonate and sulfide ions, cause chemical reactions which lead to a weakening of the coercive field strength of the magnetic material samarium-cobalt ($SmCo_5$) and the destruction of the magnet material. Encapsulation of shaped parts made from the samarium-cobalt ($SmCo_5$) by an electroplated aluminum layer about 20 um thick provides an ion barrier for protection against these atmospheric agents.

$SmCo_5$, like SmCoFe and AlNiCo, belongs to a class of "magnetically hard" materials and has especially high remanent magnetization and high coercive field strength. Interest in its practical use in engineering and especially in electrical engineering is correspondingly broad.

Like all lanthanoids, whose strongly negative normal potentials $epsilon_o$ are −2.483 (Ce) to −2.255 V (Lu), samarium is a strong reducing agent (comparable in strength to Mg for instance). Samarium therefore reacts with water (moisture) to form $H_2$ and it reacts with oxygen to form oxide, the latter reacting with $CO_2$ to form carbonate. These chemical properties are also inherent in $SmCo_5$, all be it to a lesser degree, and for this reason shaped parts of this material to be used as magnets must be encapsuled for protection against atmospheric agents. The more thorough the protection, the longer the high coercive field strength can be utilized undiminished.

Because of their permeability to oxygen and water vapor, lacquer and plastic layers cannot ensure durable protection. Metal envelopes must: protect against ion penetration of oxygen, hydroxyl and sulfur etc.; be effective in as thin a layer as possible; be able to be applied in direct contact (for full utilization of the magnetic field strength, only a small gap is permissible); and be nonmagnetic. In view of these considerations, electroplating from aqueous electrolyte baths is not possible. Vapor depositions under vacuum do not give gas-proof coatings.

The application, according to the invention, of electroplated aluminum (itself nonmagnetic) in layer thicknesses of preferably 15 to 20μm Al from aprotic, oxygen-free and anhydrous electrolyte media of the above-mentioned kind, at bath temperatures of 80 to 110° C., does not impair the magnetism of the $SmCo_5$, and avoids the problems mentioned above.

Preferably, the contact-plating is applied on the back of the magnet head of the shaped part, for example, by insertion of an aluminum wire into a small hole. After the shaped part surface has been coated with electroplated aluminum, the hole is riveted with a small piece of soft Al wire. The very ductile electroplated aluminum acts as sealing material and is eminently suitable also for friction welding, so that the encapsulation can be made tight on all sides.

An additional advantage of the electroplated Al ion barrier layer encapsulation of such shaped parts of magnet material is the possibility of imparting to them a hard, very abrasion-resistant surface by subsequent anodizing to form a "Galvano-Al-Eloxal" layer 10 to 15 μm thick. This abrasion-resistant surface can be further colorized or imprinted with technical data and information before it is compacted in boiling water. Surfaces of more than 500 HV can thus be obtained. Because of this high hardness, the surfaces can be polished mechanically.

The electroplated aluminum layer, or "Galvano-Al-Eloxal" layer is an outstanding ion barrier layer which does not allow either oxygen or hydroxyl or sulfide ions to penetrate to the magnet material $SmCo_5$ and which preserves and ensures the full functionality and high magnet quality thereof for the long term both in ordinary air and in industrial atmospheres burdened with $SO_2$ and N-0 compounds. The quality and reliability of the electroplated Al ion barrier layer on $SmCo_5$ shaped parts can be determined by measurement as a function of layer thickness, relative humidity and test temperature on test pieces stored in an air-conditioned cabinet, whose coercive field strengths are recorded as a function of the test period and compared with that of uncoated $SmCo_5$ parts of equal initial quality. The optimal layer thicknesses for the "Galvano-Al" and "Galvano-Al-Eloxal" layers of the $SmCo_5$ parts can be determined in the same manner.

A forced test of specimens of the above-mentioned kind can also be carried out in moist nitrogen-oxygen mixtures of 50:50 per cent by volume or by weight, at 25, 60 or 80° C. Thereafter, the edge layers of the $SmCo_5$ part transformed into oxide or hydroxide can be observed visually under the microscope in transverse ground sections of the specimens. The $Sm_2O_3$ is well recognizable because of its yellow color.

EXAMPLE 3

Shaped parts of uranium metal, particularly so-called depleted uranium metal, may be enveloped with 10 to 30 um (depending on their dimensions) and more of electroplated aluminum as an ion barrier, especially for oxygen and hydroxyl ions as well as for uranyl ions. On the one hand, the ion barrier protects the uranium, which has a high oxygen affinity, against oxidation and, on the other hand, the barrier prevents contact with the poisonous heavy metal and its oxidation products when handling the shaped parts.

Because of its extremely high density of 18.97 (g/cc), its good mechanical properties and its relatively high melting point of 1132° C., uranium metal is used for ballasting and counter weights (trim weights) in aircraft, ships, rockets and gyroscopes (for the stabilization of aiming devices) as well as for shields against gamma and X-radiation in instruments and vessels. However, while it is an almost ideal metal for such applications, having a normal potential of epsilono (for $U/U^{4+}) = -1.494$ V it is unfortunately a rather base metal which immediately tarnishes in air (i.e. oxidizes) and is quickly attacked by dilute acids, even by boiling water, in accordance with the following reaction:

$$U + 2\,H_2O \rightarrow UO_2\downarrow + 2\,H_2\uparrow.$$

Because the tarnish films do not adhere firmly and can be wiped off, and because uranium, being a heavy metal, is poisonous irrespective of its radioactivity the above-mentioned shaped parts must be enveloped with a protective coating for handling and use. Until now this has been done more or less inadequately with plastic coverings or nickel coatings from aqueous electrolyte baths.

The invention is an improvement over the above-mentioned process. According to the invention, the uranium metal parts are clamped in a cathode frame, immediately after their production and dimensionally correct mechanical surface treatment, in dry inert gas atmosphere of repurified nitrogen or argon. At the same time, the parts are contacted and lowered through a sluice into the aprotic, oxygen-free and anhydrous aluminum-organic complex salt electrolyte medium of the above-mentioned composition. The parts are coated on all sides with 10 to 30μm electroplated aluminum with cathode agitation (reciprocating movement or rotation for cylindrical parts), at a bath temperature of 80 to 110° C. and a current density of between 0.5 and 3 $A/dm^2$. A very good adhesion of the electroplated Al ion barrier layer to the bare, oxide- and cover-layer-free uranium surface may be obtained. The adhering electrolyte liquid is washed off by spraying with toluene and rinsing in toluene/isopropanol and the coated part is dried under nitrogen in an (infra) red radiation drier.

If desirable and advantageous, the electroplated Al layer can be mechanically compacted and strengthened by blasting with glass beads or drumming with hard particles. The Al layer can also be transformed superficially by anodic oxidation in a GS, GSX or GX bath into hard, abrasion-resistant "Galvano-Al-Eloxal" and the latter can be compacted in boiling water. Thus, a dense, glass-clear and hard-as-ceramic Galvano-Al-Eloxal layer is obtained on the silver bright electroplated aluminum of the ion barrier layer.

If necessary, the "Galvano-Al-Eloxal" layer can be colorized in any color and/or lettered before compacting for identification of the parts. Following the colorization or printing, compacting is carried out for about 30 minutes in boiling water, whereby the dye or ink is incorporated in the hard surface so as to be waterproof.

By these coating methods according to the invention, an ion-proof and very durable covering of the uranium metal parts is obtained which prevents oxidation of the uranium and precludes out-diffusion of uranyl ions, $UO_2^{2+}$, as well as of uranium oxides. The effectiveness of this covering as an ion barrier can be tested by storage of the parts in a hot air cabinet or air-conditioned cabinet (air and moisture). Penetrating $UO_2^{2+}$ions can easily be evidenced in UV light by their green fluorescence. $UO_2$ formed due to the penetration of hydroxyl ions is easily recognizable by its brown-black color, and the concomitantly forming hydrogen leads to bubble formation under the coating. With a sufficiently thick and dense electroplated Al ion barrier layer of at least 10 um on all sides, such penetration phenomena do not occur. Depending on the size and weight of the uranium part, thicker electroplated Al layers may be appropriate, to ensure durable safety when the parts are handled repeatedly.

In an analogous manner shaped parts of beryllium, thallium, etc. can also be covered with an electroplated Al ion barrier layer.

What is claimed is:

1. A method for the production of an ion barrier layer on a surface of a metallic material or on an electroconductive surface of a nonmetallic material, comprising the step of electrodepositing an aluminum layer on the surface of the metallic material or on the electroconductive surface of the nonmetallic material from an aprotic, oxygen-free, anhydrous aluminum-organic complex salt electrolyte of the general formula $M^IX.2AlR_3.nLsm$, wherein:

$M^I$ is an alkali metal ion or a quaternary onium ion,
X is a halogen ion,
R is an alkyl radical,
Lsm is an aromatic solvent molecule, and
n=0 to 12 moles.

2. A method for the production of an ion barrier layer according to claim 1 wherein the step of electrodepositing is conducted in the presence of a bath of aromatic solvent at a bath temperature of 50 to 110° C. and at a current density of 0.5 to 10 $A/dm^2$ under intensive bath movement.

3. A method for the production of an ion barrier layer according to claim 1 further comprising the step of compacting the layer.

4. A method for the production of an ion barrier layer according to claim 1 further comprising the step of anodically oxidizing the layer.

5. A method for the production of an ion barrier layer according to claim 1, wherein:

X is $F^-$ or $Cl^-$,
R is $CH_3$, $C_2H_5$, $C_3H_7$ or $C_4H_9$, and
Lsm is toluene, ethyl benzene, xylene or mixtures thereof.

6. A copper conductor wire having an aluminum ion barrier layer electroplated thereon produced according to the method of claim 1.

7. A magnetic material having an aluminum ion barrier layer encapsulated thereon produced according to the method of claim 1.

8. A uranium material having an aluminum ion barrier layer encapsulated thereon produced according to the method of claim 1.

9. A method for the production of an ion barrier layer on a surface of a metallic material or on an electroconductive surface of a nonmetallic material, comprising the step of electrodepositing an aluminum layer having a purity of greater than 99.9% aluminum and a thickness of 10 to 20 um on the surface of the metallic material or on the electroconductive surface of the nonmetallic material from an aprotic, oxygen-free, anhydrous aluminum-organic complex salt electrolyte of the general formula $M^IX.2RlR_3.nLsm$, wherein:

$M^I$ is an alkali metal ion or a quaternary onium ion,
X is a halogen ion,
R is an alkyl radical,
Lsm is an aromatic solvent molecule, and
n=o to 12 moles.

* * * * *